US005703953A

United States Patent [19]

Otoguro

[11] Patent Number: 5,703,953

[45] Date of Patent: Dec. 30, 1997

[54] MONAURAL SIGNAL JUDGEMENT CIRCUIT

[75] Inventor: Yoshishige Otoguro, Tokyo, Japan

[73] Assignee: LG Electronics Inc., Seoul, Rep. of Korea

[21] Appl. No.: 628,157

[22] Filed: Apr. 5, 1996

[30] Foreign Application Priority Data

Apr. 7, 1995 [JP] Japan ..... 7-082865

[51] Int. Cl.[6] ..... H04H 5/00

[52] U.S. Cl. ..... 381/12

[58] Field of Search ..... 381/12, 28, 1, 381/17, 86, 63, 11

[56] References Cited

U.S. PATENT DOCUMENTS

| | | | |
|---|---|---|---|
| 4,236,041 | 11/1980 | Thomas | 381/12 |
| 4,404,432 | 9/1983 | Kusakabe | 381/12 |
| 4,455,673 | 6/1984 | Topping | 381/12 |
| 5,210,796 | 5/1993 | Hirabayashi | 381/12 |
| 5,272,756 | 12/1993 | Tanaka et al. | 381/12 |

*Primary Examiner*—Curtis Kuntz
*Assistant Examiner*—Xu Mei

[57] ABSTRACT

An improved monaural signal judgement circuit which is capable of judging whether or not an input signal is monaural when signals from a television, a video cassette tape recorder, an audio cassette tape recorder, a compact disc player, or the like are inputted to the monaural signal judgement circuit and of converting the process into a pseudo stereo function when the input signal is monaural, which includes a wave form shaping circuit for separately wave-form-shaping a left-side signal and a right-side signal inputted thereto; an operation circuit for computing a signal level difference of the wave-form-shaped right-side and left-side signals; a control signal setting circuit for setting a control signal in accordance with an output of the operation circuit; an input control circuit connected between an input side of the operation circuit and an output side of the control signal setting circuit for adjusting a signal level at an input side of the operation circuit in accordance with a control signal applied thereto and for controlling a signal level difference at an output side of the operation circuit to be within a predetermined range; and a signal detection circuit for detecting whether or not a monaural signal is present by detecting whether or not an output signal of the operation circuit is within a predetermined range.

10 Claims, 3 Drawing Sheets

SIGNAL DETECTION CIRCUIT
H/L
h
i
1
2
3
4
5
a
b
c
d
e
f
g
R1
R2
R3
R4
R5
R6
R7
R8
R9
R10
R11
R12
R13
R14
R15
R16
R17
R18
R19
D1
D2
D3
D4
D5
Q1
Q2
Q3
Q4
Q5
Q6
Q7
L
R

MONAURAL SIGNAL JUDGEMENT CIRCUIT

FIELD OF THE INVENTION

The present invention relates to a monaural signal judgement circuit, and particularly to an improved monaural signal judgement circuit which is capable of judging whether or not an input signal is monaural when signals from a television, a video cassette tape recorder, an audio cassette tape recorder, a compact disc player, or the like are inputted to the monaural signal judgement circuit and of converting the process into a pseudo stereo function when the input signal is monaural.

DESCRIPTION OF THE CONVENTIONAL ART

FIG. 1 shows a conventional signal judgement circuit, which includes an operation circuit 10 and a signal detection circuit 11. In the drawing, L denotes a left-side signal, and R denotes a right-side signal. In addition, an expression "Ra=Rb=Rc=Rd" is satisfied.

In the above-mentioned construction, the levels of an L-signal and R-signal are the same at a point P at an operation amplifier Q, that is, a monaural signal. When an expression "Ra=Rb=Rc=Rd" is satisfied, the output at the point P is theoretically zero (0) which is detected by the signal detection circuit 11 and may be judged as a monaural signal. Therefore, in the monaural signal, when an L/R signal has not the same level, the output of the operation circuit 10 is not zero (0).

However, in the conventional monaural signal judgement circuit, there is an output difference between an L-signal and a R-signal due to a dispersion of a resistance value. In addition, since a frequency characteristic is not constant between L/R signals, it is impossible to obtain the same level of L/R signals in a band pass region. As a result, since a level-difference signal appears at the point P at the output side of the operation circuit 10, it is impossible to recognize the level-difference signal and the output signal outputted by a phase difference of a stereo or the like.

SUMMARY OF THE INVENTION

Accordingly, it is an object of the present invention to provide a monaural signal judgement circuit, which overcomes the problems encountered in a conventional monaural signal judgement circuit.

It is another object of the present invention to provide an improved monaural signal judgement circuit which is capable of judging whether or not an input signal is monaural when signals from a television, a video cassette tape recorder, an audio cassette tape recorder, a compact disc player, or the like are inputted to the monaural signal judging circuit and of converting the process into a pseudo stereo function when the input signal is monaural.

To achieve the above objects, there is provided a monaural signal judgement circuit, which includes a wave form shaping circuit for separately wave-form-shaping a left-side signal and a right-side signal inputted thereto; an operation circuit for computing a signal level difference of the wave-form-shaped right-side and left-side signals; a control signal setting circuit for setting a control signal in accordance with an output of the operation circuit; an input control circuit connected between an input side of the operation circuit and an output side of the control signal setting circuit for adjusting a signal level at an input side of the operation circuit in accordance with a control signal applied thereto and for controlling a signal level difference at an output side of the operation circuit to be within a predetermined range; and a signal detection circuit for detecting whether or not a monaural signal is present by detecting whether or not an output signal of the operation circuit is within a predetermined range.

DETAILED DESCRIPTION OF THE INVENTION

Figure 1:
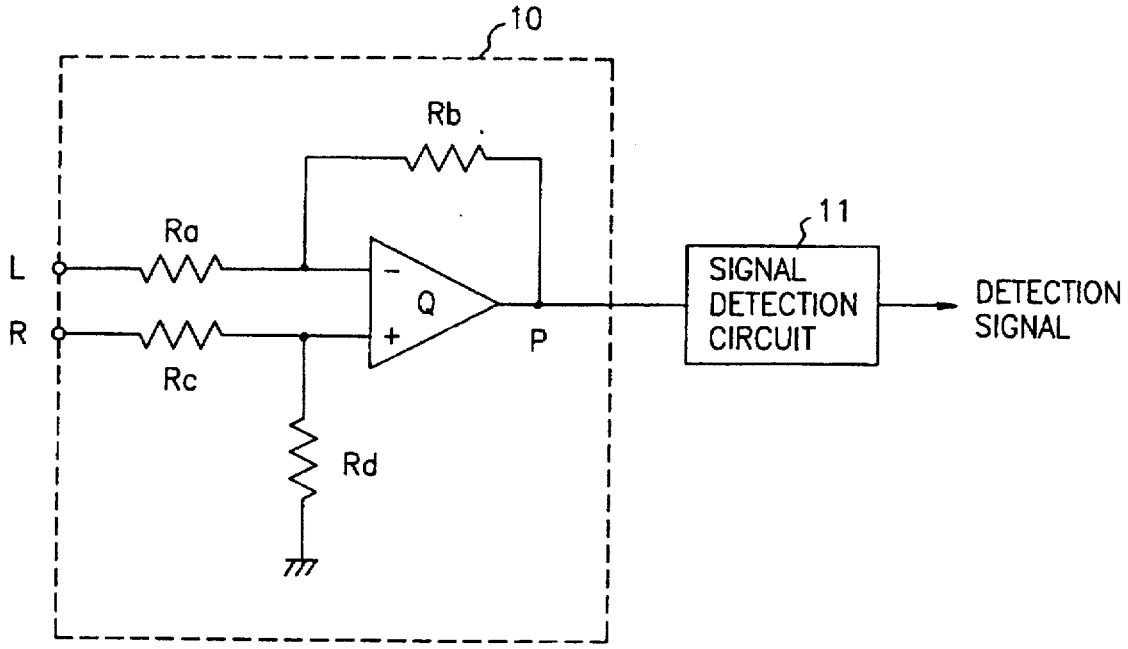
FIG. 1 CONVENTIONAL ART
FIG. 1 is a circuit diagram of a conventional monaural signal judgement circuit.
Figure 2:
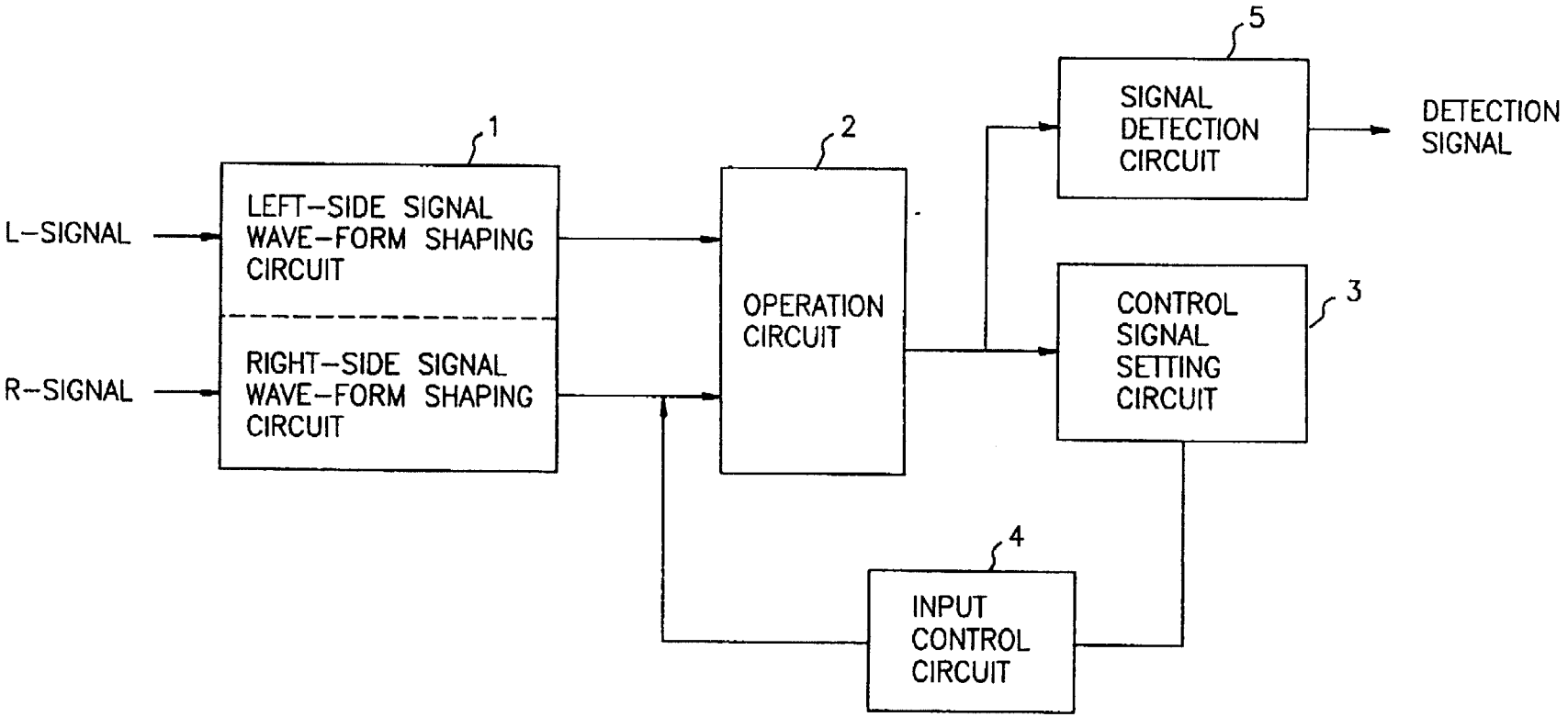
FIG. 2 is a block diagram so as to explain a basic principle of a monaural signal judgement circuit according to the present invention.

FIG. 2 shows a basic principle of the monaural signal judgement circuit, which includes a wave form shaping circuit 1 for separately shaping a left-side signal L and a right-side signal R, an operation circuit 2 for computing a level difference of a right-side signal and a left-side signal which are inputted thereto, a control signal setting circuit 3 for setting a control signal in accordance with an output of the operation circuit 2, an input control circuit 4 connected between an input-side of the operation circuit 2 and an output-side of the control signal setting circuit 3 for adjusting a signal level of the input-side of the operation circuit 2 and for controlling a signal level difference to be within a predetermined range (for example, to be zero (0)), and a signal detection circuit 5 for detecting whether or not an output signal of the operation circuit is within a predetermined range and for judging whether or not a monaural signal is applied thereto.

In addition, the input control circuit 4 includes a first resistor R13 and a second resistor R14 for adjusting a signal level of the input-side of the operating circuit by selecting a value of the first resistor R13 or the second resistor R14, and a transistor Q7 for turning on/off the input control circuit 4 in accordance with a control signal applied to the base thereof.

When a different level of an L/R signal is inputted to the operation circuit 2, the distribution of the resistance value of a group of the resistors at the input side is adjusted using a control signal generated at the rear side so that the input level of the other side can be constant on the basis of an input level of another side.

Figure 3:
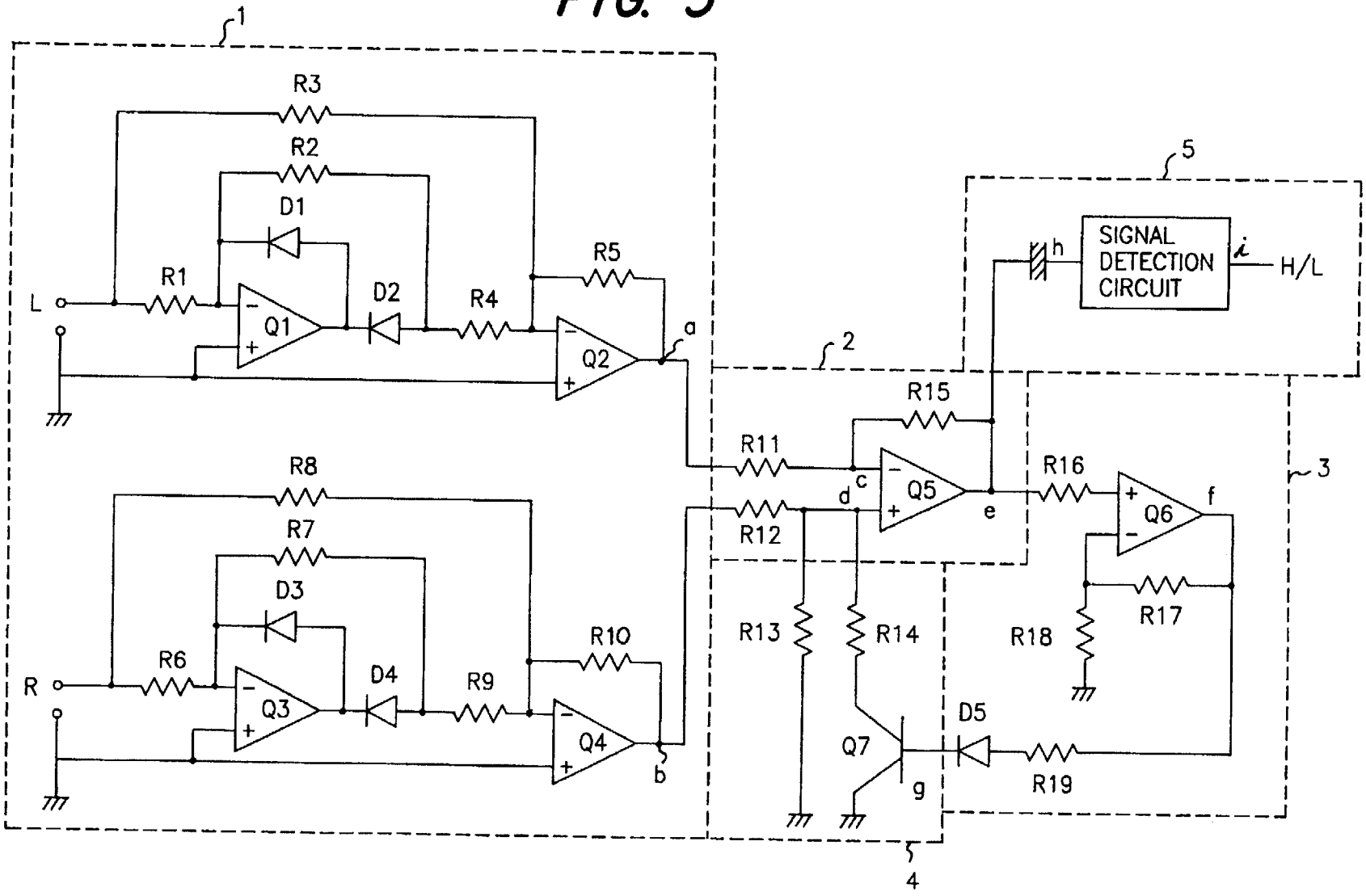
FIG. 3 is a block diagram of a monaural signal judgement circuit according to the present invention.

FIG. 3 shows a first embodiment of the present invention. In this embodiment, it is judged whether or not a monaural signal is present in accordance with a signal level of a point "e" at the output side of the operation amplifier Q5. That is, when the signal level of a point "d" at the input side of the operation amplifier Q5 is adjusted to be the same as the signal level of the point "e" based on a point "c" at the input side and to have an opposed phase, since the phase of the monaural signal is the same, the signal level becomes zero (0) at the point "e" when the signals are concurrently inputted thereto. Meanwhile, in case of a stereo signal, since there is a phase difference between the left-side/right-side signals, the signal level does not become zero (0) at the point "e". Therefore, when the signal level is zero (0) at the point "e", it is judged that the signal applied thereto is a monaural signal.

The operation of the monaural signal judgement circuit will now be explained with reference to the accompanying drawings.

In the drawing, reference numeral 1 denotes a wave form shaping circuit for wave-shaping (rectifying) an input signal so as to improve a judgement efficiency, and reference numeral 2 denotes an operation circuit by which the level and phase of the signal of points "a" and "b" at the output side of the wave form shaping circuit 1 is judged. That is, it is judged whether or not the left side signal L and the right side signal R have the same level or the same phase. Reference numeral 3 denotes a control signal setting circuit for eliminating a level difference between the left-side/right-side signal. Reference numeral 4 denotes an input control circuit for controlling the signal level of the point "b" to be within a range of ±x(dB) with respect to the point "a" about the input difference of the points "a" and "b". Reference numeral 5 denotes a signal detection circuit for judging whether or not the output at the point "e" of the operation circuit 2 is zero (0) and for outputting a detection signal in accordance with the result of the judgement.

In addition, the wave form shaping circuit 1 has the same construction at the left-side and the right-side, and each channel includes operation amplifiers Q1, Q2, Q3, and Q4. The L/R signal is entirely rectified by diodes D1, D2, D3 and D4 at the output side of the operation amplifiers Q1 and Q3. Therefore, a negative input signal is converted into a positive input signal by the entire rectification, thereby improving a judgement performance. The output obtained by the entire rectification at the points "a" and "b" is inputted to the operation circuit 2.

The operation circuit 2 includes an operation amplifier Q5. The input control circuit 4 includes a transistor Q7, and the control signal setting circuit 3 includes an operation amplifier Q6. The output of the operation circuit 2 is outputted to the signal detection circuit 5.

In the above-described construction, a signal at the point "a" is transmitted to the point "c" through a resistor R11, and a signal at the point "b" is transmitted to the point "d" through a resistor R12. In this case, the resistors R13 and R14 of the input control circuit 4 is controlled so that the signal level at the point "b" is the same level within a range of ±x(dB) with respect to the signal level at the point "a".

That is, when the transistor Q7 is turned off, the following expression is obtained.

The signal level at the $$\text{point "d"}=(R13\times b)/(R12+R13) \quad (1)$$

Each resistor is controlled so that the output to the point "e" by the signal level at the point "d" is higher than the output to the point "c" by the signal level at the point "a" by "x(dB)".

Meanwhile, when the transistor Q7 is turned on, the following expression is obtained.

The signal level at the $$\text{point "d"}=[(R13 \| R14)\times b]/[R12-(R13 \| R14)] \quad (2)$$

The signal level at the point "d" is lower than the output to the point "e" by the point "a" by "x(dB)". Here, "‖" denotes a parallel sign.

Therefore, in the operation amplifier Q5, when the monaural signal level at the point "a" is higher than the signal level at the point "b" by "x(dB)", and the signal level at the point "e" is zero (0). When the signal level at the point "a" is "+x(dB)>(b−a)>−x(dB), since the signal at the points "a" and "b" are positive, the positive signal is always outputted at the point "e".

In addition, the output of the operation amplifier Q5 is inputted to the control signal setting circuit 3 at the point "e", and amplified by the operation amplifier Q6, and then a control signal is outputted at the point "f". The control signal is applied to the base of the transistor Q7 through a diode D5. The transistor Q7 is turned on in accordance with an output of the diode D5, so that the signal level at the point "d" is lowered. When a monaural signal is present, since the phases at the points "c" and "d" are the same, the signal level at the point "e" becomes zero (0) by the transistor Q7.

However, when the monaural signal is not present, since the phases at the points "a" and "b" are different, an output difference appears at the point "e", so that it is impossible to obtain a desired balance by the transistor Q7. Therefore, the signal detection circuit 5 has the same L/R phases when the input is zero (0) at the point "h" at the input side, and it is judged that the level difference of the L/R signals is a monaural signal within a range of ±x(dB), and the signal detection circuit outputs a detection signal at the point "T".

As described above, it is possible to more effectively judge a monaural signal in a television, a stereo device, and the like.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A monaural signal judgement circuit, comprising:

wave-form-shaping means for separately wave-form-shaping a left-side signal and a right-side signal inputted thereto;

operation means for computing a signal level difference of the wave-form-shaped right-side and left-side signals;

control signal setting means for setting a control signal in accordance with an output of said operation means;

input control means connected between an input side of the operation means and output side of said control signal setting means for adjusting a signal level at an input side of the operation means in accordance with a control signal applied thereto and for controlling a signal level difference at an output side of the operation means to be within a predetermined range; and signal detection means for detecting whether or not a monaural signal is present by detecting whether or not an output signal of the operation means is within a predetermined range.

2. The circuit of claim 1, wherein said input control means includes a first resistor, a second resistor, and a transistor which is turned on/off in accordance with a control signal applied to the base of said transistor, and is directed to adjusting a signal level at an input side of the operation means by selecting said first resistor or said second resistor.

3. The circuit of claim 1, wherein stereo signals are determined by a non-judgement of monaural signals.

4. A method for judging inputted signals by a monaural signal judgement circuit to determine whether the inputted signals are monaural, comprising the steps of:

generating a wave-form shape for a left-side signal and a right-side signal inputted to the monaural signal judgement circuit;

computing a signal level difference between the generated left-side wave form shape and right-side wave form shape;

setting a control signal based on the computed signal level difference;

adjusting the signal level of one of the generated left-side or right-side wave form shapes based on the control signal;

controlling the signal level difference to be within a predetermined range; and detecting a monaural signal based on the signal level difference being within the predetermined range.

5. The method of claim 4, wherein the inputted signals to the monaural signal judgement circuit are one of a television signal, a video cassette tape recorder signal, an audio cassette tape recorder signal, a compact disc player signal.

6. The method of claim 4, wherein detection of the signal level difference not within the predetermined range indicates a detection of stereo signals instead of monaural signals.

7. A signal judgement circuit for determining monaural and stereo signals, comprising:

an operation amplifier having a first and second input for receiving a left-side and right-side input signals respectively and for outputting a signal level based on the inputted signals;

an adjusting means for adjusting a signal level of an input to the operation amplifier to be the same as the signal level output from the operation amplifier;

a detection means for determining whether the signal level at the output of the operation amplifier is the same as the signal level of the adjusted input to the operation amplifier wherein the detection means detects an output signal level of zero for monaural signals and non-zero output signal levels for stereo signals.

8. The signal judgement circuit of claim 7, wherein the detection means detects monaural signals when the inputted signals to the operation amplifier have a same phase and stereo signals when the inputted signals to the operation amplifier have a different phase.

9. A monaural signal judgement circuit, comprising:

a wave-form shaping circuit having a left and right portion for rectifying left-side and right-side signals respectively;

an operation circuit having a first and second input for receiving the rectified left-side and right-side signals and for judging whether a signal level and phase of the rectified left-side signal and right-side signal are the same;

control signal setting circuit for eliminating a signal level difference between the rectified left-side signal and right-side signal;

input control circuit for controlling a signal level of an input to the operation circuit to be within a predetermined (dB) range of a signal level of the other input to the operation circuit; and signal detection circuit for detecting a signal level of the output of the operation circuit and upon detection of a zero signal level outputting a detection signal indicating monaural signals.

10. The monaural signal judgement circuit of claim 9, wherein the operation circuit includes an operation amplifier having a first and second input, a first resistor coupled to the first input of the operation amplifier and the left-side wave-form is transmitted through said first resistor, and a second resistor coupled to the second input of the operation amplifier and the right-side wave-form is transmitted through said second resistor.

* * * * *